US009315060B2

(12) United States Patent
Sasaki et al.

(10) Patent No.: US 9,315,060 B2
(45) Date of Patent: Apr. 19, 2016

(54) RECORDING APPARATUS

(71) Applicant: SEIKO EPSON CORPORATION, Tokyo (JP)

(72) Inventors: Tsuneyuki Sasaki, Matsumoto (JP); Osamu Hara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/665,661

(22) Filed: Mar. 23, 2015

(65) Prior Publication Data

US 2015/0273920 A1 Oct. 1, 2015

(30) Foreign Application Priority Data

Mar. 26, 2014 (JP) ..... 2014-064548

(51) Int. Cl.

| | |
|---|---|
| ***B41J 29/393*** | (2006.01) |
| ***B41J 25/00*** | (2006.01) |
| ***H04R 1/08*** | (2006.01) |
| ***B41J 29/46*** | (2006.01) |
| ***B41J 29/02*** | (2006.01) |
| ***B41J 29/10*** | (2006.01) |
| ***B41J 29/38*** | (2006.01) |

(52) U.S. Cl.

CPC ..... *B41J 29/393* (2013.01); *B41J 25/001* (2013.01); *B41J 29/02* (2013.01); *B41J 29/10* (2013.01); *B41J 29/38* (2013.01); *B41J 29/46* (2013.01); *H04R 1/08* (2013.01)

(58) Field of Classification Search

CPC ..... B41J 29/393

See application file for complete search history.

(56) References Cited

U.S. PATENT DOCUMENTS

| | | | | |
|---|---|---|---|---|
| 5,334,920 | A * | 8/1994 | Ito et al. | 318/685 |
| 7,457,550 | B2 | 11/2008 | Shoji et al. | |
| 7,502,570 | B2 | 3/2009 | Nishimura | |
| 2004/0205403 | A1 * | 10/2004 | Markow et al. | 714/30 |

FOREIGN PATENT DOCUMENTS

| | | |
|---|---|---|
| JP | 2006-201316 | 8/2006 |
| JP | 2007-079263 | 3/2007 |
| JP | 2008-304872 | 12/2008 |

* cited by examiner

*Primary Examiner* — Julian Huffman

(74) *Attorney, Agent, or Firm* — Workman Nydegger

(57) ABSTRACT

There is provided a recording apparatus including a movement unit that reciprocates while sliding along guide shafts and sound collection units that are disposed in the movement unit so as to collect a sound generated due to sliding of the guide shafts. According to the recording apparatus configured in this way, it is possible to perceive a change in a sliding state in the movement unit which reciprocates while sliding along the guide shafts.

9 Claims, 10 Drawing Sheets

RECORDING APPARATUS

BACKGROUND

1. Technical Field

The present invention relates to a recording apparatus.

2. Related Art

In the related art, recording apparatuses have been used which forms an image on a recording medium. Among the recording apparatuses, a recording apparatus is disclosed which detects an abnormality of the recording apparatus by using a sound generated inside the recording apparatus.

For example, JP-A-2008-304872, JP-A-2006-201316, and JP-A-2007-79263 disclose the recording apparatus which detects the abnormality of the recording apparatus by using the sound generated inside the recording apparatus.

In a recording apparatus having a movement unit which reciprocates while sliding along a guide shaft, in some cases, a friction force between the guide shaft and the movement unit is changed, and a sliding state is changed, thereby causing sliding failure (abnormal reciprocating movement) to occur.

However, in some cases, even the recording apparatus including a detection unit for detecting the abnormality of the recording apparatus by using the sound generated in the recording apparatus cannot detect the abnormal reciprocating movement, depending on configurations or positions of the detection unit.

The recording apparatus disclosed in JP-A-2008-304872, JP-A-2006-201316, and JP-A-2007-79263 has no disclosure related to the abnormal reciprocating movement in the recording apparatus having the movement unit which reciprocates while sliding along the guide shaft, and has no configuration by which the abnormal reciprocating movement can be detected.

SUMMARY

An advantage of some aspects of the invention is to perceive a change in a sliding state in a movement unit which reciprocates while sliding along a guide shaft.

According to an aspect of the invention, there is provided a recording apparatus including a movement unit that reciprocates while sliding along a guide shaft, and a sound collection unit that is disposed in the movement unit and collects a sound generated due to the sliding.

In the recording apparatus, a sound reception portion of the sound collection unit may be disposed to oppose a surface of the guide shaft in the movement unit at a position by keeping a distance of 0.1 mm to 10 mm therefrom.

In the recording apparatus, the sound collection unit may be a silicon microphone.

The recording apparatus may further include a determination unit that determines whether the reciprocating movement of the movement unit is normal or abnormal, based on a sound collection result of the sound collection unit.

In the recording apparatus, the determination unit may determine whether the reciprocating movement of the movement unit is normal or abnormal, by comparing a reference sound with a sound collected by the sound collection unit.

In the recording apparatus, the reference sound may be a sound which is predetermined corresponding to aging of a sliding state of the movement unit along the guide shaft.

In the recording apparatus, the movement unit may slide along the guide shaft via a lubricant, and the determination unit may output information indicating the time to supply a lubricant to a contact portion with the guide shaft in the movement unit, based on a sound collection result of the sound collection unit.

In the recording apparatus, the determination unit may output information indicating that the reciprocating movement of the movement unit is abnormal when determining the reciprocating movement of the movement unit is abnormal.

The recording apparatus may further include a processing unit that processes a sound collected by the sound collection unit. The processing unit may include an output unit which outputs a first sound collection value obtained by collecting a sound generated due to the repeated reciprocating movement during a first predetermined time period and a second sound collection value obtained by collecting a sound generated due to the repeated reciprocating movement during a second predetermined time period, so as to be comparable with each other.

The recording apparatus may further include a processing unit that processes a sound collected by the sound collection unit. The processing unit may include an output unit which outputs a first sound pressure-position graph for obtaining a relationship of a sound pressure value with a position in a movement direction of the movement unit by collecting a sound generated due to the repeated reciprocating movement during a first predetermined time period, and a second sound pressure-position graph for obtaining a relationship of a sound pressure value with a position in the movement direction of the movement unit by collecting a sound generated due to the repeated reciprocating movement during a second predetermined time period, so as to be comparable with each other.

In the recording apparatus, the processing unit may separately obtain the first sound pressure-position graph and the second sound pressure-position graph in a forward route and a rearward route in the reciprocating movement.

According to the aspect of the invention, it is possible to detect an abnormal reciprocating movement in a movement unit which can reciprocate while sliding along a guide shaft.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a recording apparatus according to an embodiment of the invention will be described in detail with reference to accompanying drawings.

First, an outline of a recording apparatus 1 according to the present embodiment will be described.

Figure 1:
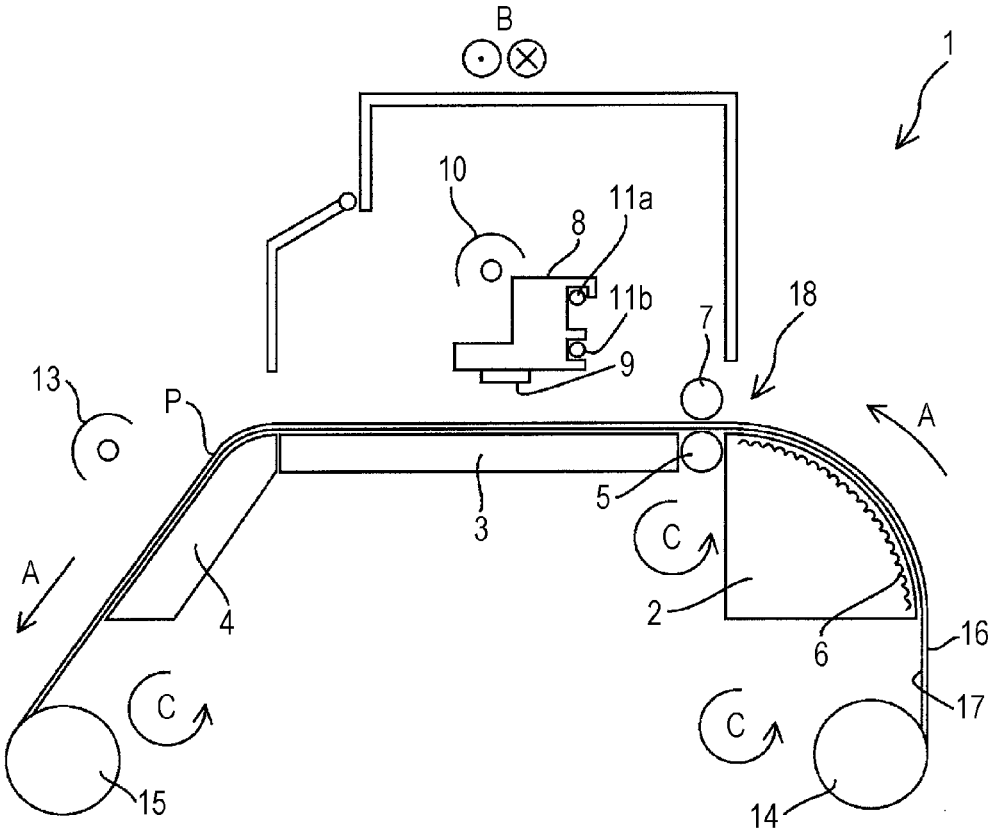
FIG. 1 is a schematic side view illustrating a recording apparatus according to an embodiment of the invention.

FIG. 1 is a schematic side view illustrating the recording apparatus 1 according to the embodiment of the invention.

As illustrated in FIG. 1, the recording apparatus 1 according to the embodiment transports a recording medium P in a transport direction A from a setting unit 14 of the recording medium P to a winding unit 15 of the recording medium P via platens 2, 3, and 4 which are support portions of the recording medium P. That is, a section from the setting unit 14 to the winding unit 15 is a transport route of the recording medium P in the recording apparatus 1, and the platens 2, 3, and 4 are the support portions of the recording medium P which are disposed in the transport route. The setting unit 14 feeds the recording medium P by being rotated in a rotation direction C, and the winding unit 15 winds the recording medium P by being rotated in the rotation direction C.

The recording apparatus 1 according to the embodiment adopts a configuration in which recording can be performed on the recording medium P formed in a roll shape. However, without being limited to this configuration, the recording apparatus 1 may adopt a configuration in which the recording can be performed on the recording medium P formed in a single sheet shape. When the configuration in which the recording can be performed on the recording medium P formed in the single sheet shape is adopted, as the setting unit 14 of the recording medium P, a so-called sheet feeding (delivery) tray and a so-called sheet feeding (delivery) cassette may be used, for example. As a collection unit of the recording medium P and as a collection unit other than the winding unit 15, a so-called discharged sheet reception unit, a so-called sheet discharge (discharging) tray, and a so-called sheet discharge (discharging) cassette may be used, for example.

The embodiment employs a roll type of the recording medium P whose recoding surface 16 is wound to face outward. Accordingly, when the recording medium P is fed from the setting unit 14, a rotary shaft of the setting unit 14 is rotated in the rotation direction C. On the other hand, in a case of employing a roll type of the recording medium P whose recoding surface 16 is wound to face inward, the recording medium P can be fed by rotating the rotary shaft of the setting unit 14 in a direction opposite to the rotation direction C.

Similarly, the winding unit 15 according to the embodiment winds the recording medium P so that the recording surface 16 faces outward. Accordingly, the rotary shaft of the winding unit 15 is rotated in the rotation direction C. On the other hand, when the recording medium P is wound so that the recording surface 16 faces inward, the recording medium P can be wound by rotating the rotary shaft of the winding unit 15 in the direction opposite to the rotation direction C.

The platen 2 of the recording apparatus 1 according to the embodiment has a heater 6. The heater 6 is disposed in order to heat (so-called pre-heat) the recording medium P before a recording head 9 serving as a recording unit performs recording.

The recording apparatus 1 according to the embodiment adopts a configuration in which the recording medium P is pre-heated from a surface 17 side opposite to the recording surface 16 of the recording medium P by using the heater 6. However, a configuration may be adopted in which the recording medium P is pre-heated from the recording surface 16 side by using a heater which can heat the recording medium by emitting infrared rays from the recording surface 16 side of the recording medium P.

The recording apparatus 1 according to the embodiment has a driving roller 5 which has a rotary shaft in a direction B intersecting the transport direction A between the platen 2 and the platen 3, and which applies a feeding force to the surface 17 of the recording medium P. Then, the recording apparatus 1 has a driven roller 7 which has a rotary shaft in the direction B at a position opposing (above) the driving roller 5. The driving roller 5 and the driven roller 7 which configure a roller pair pinch the recording medium P, thereby enabling the recording medium P to be transported. That is, the driving roller 5 and the driven roller 7 configure a transport unit 18. Here, the driven roller means a roller rotated in response to the transport of the recording medium P.

When the recording medium P is transported in the transport direction A, the driving roller 5 is rotated in the rotation direction C, and the driven roller 7 is rotated in the direction opposite to the rotation direction C. When the recording medium P is transported in the direction opposite to the transport direction A, the driving roller 5 is rotated in the direction opposite to the rotation direction C, and the driven roller 7 is rotated in the rotation direction C.

The recording apparatus 1 according to the embodiment includes the recording head 9 serving as the recording unit, on a side opposing the platen 3. The recording apparatus 1 forms a desired image by ejecting an ink onto the recording medium P through an ink discharging surface of the recording head 9 while causing the recording head 9 to reciprocate in the direction B intersecting the transport direction A via a carriage 8 serving as a movement unit.

The recording apparatus 1 according to the embodiment includes guide shafts 11*a* and 11*b* extending in the direction B intersecting the transport direction A of the recording medium P. The carriage 8 is configured to be capable of reciprocating in the direction B while sliding along the guide shafts 11*a* and 11*b*. The carriage 8 has silicon microphones 12*a*, 12*b*, and 12*c* (refer to FIGS. 4 and 5) serving as a sound collection unit which collects a sound generated due to the sliding.

In this way, the silicon microphones 12*a*, 12*b*, and 12*c* are disposed in the carriage 8. Accordingly, it is possible to detect an abnormal reciprocating movement in the carriage 8 which can reciprocate while sliding along the guide shafts 11*a* and 11*b*.

Here, the silicon microphone is a small microphone which is produced by using single crystal silicon as a material through semiconductor micro-fabrication technology.

As the sound collection unit, a unidirectional sound collection unit is preferably used since the unidirectional sound collection unit is hardly affected by noise. However, the sound collection unit is not limited to the unidirectional sound collection unit.

The "sound collection unit" means a unit which converts a sound into an electric signal by causing a sound reception portion to receive the sound. The "sound reception portion" means a portion which vibrates by receiving a sound (sound pressure). The "sound" also includes frequency in a non-audible range without being limited to frequency in a human audible range.

As described above, the recording apparatus 1 according to the embodiment employs the silicon microphones 12*a*, 12*b*, and 12*c* as the sound collection unit. The silicon microphone is small and has an advantageous sound collection effect. Moreover, the silicon microphone has excellent durability and can be used for a long period of time under various environmental conditions. Therefore, the silicon microphone is arranged close to a desired location for sound collection, and serves as very precise and long-term durable sound collection unit.

A heater 10 serving as a heating unit which can radiate electromagnetic waves toward a recording region of the recording head 9 is disposed at a position opposing the platen 3 which is located above the recording head 9.

The heater 10 according to the embodiment is an infrared heater which is disposed at the position opposing the platen 3 and can heat a surface on the recording surface 16 side of the recording medium P up to 35° C. to 50° C. Here, a preferred wavelength of infrared rays is 0.76 μm to 1000 μm. In general, the infrared rays are further classified into near infrared rays, mid-infrared rays, and far infrared rays depending on the wavelength. The classification is defined in various ways. However, the wavelength ranges are approximately 0.78 μm to 2.5 μm, 2.5 μm to 4.0 μm, and 4.0 μm to 1000 μm. Among these, it is preferable to use the mid-infrared rays.

A heater 13 which can radiate the electromagnetic waves is provided at a position opposing the platen 4 on a downstream side in the transport direction A from the platen 3. The heater 13 is an infrared heater which can heat a surface of the recording medium P up to 60° C. to 120° C. in order to dry the ink used for the recording apparatus 1 according to the embodiment. However, the heater 13 is not limited to this dryer. For example, as the dryer, it is also possible to use a blower such as a fan in addition to a heating device such as the infrared heater.

As illustrated in FIG. 1, in the recording apparatus 1 according to the embodiment, the transport unit 18 configured to have the driving roller 5 and the driven roller 7 is disposed on an upstream side of the recording head 9 in the transport direction A. However, the transport unit 18 may be disposed on both sides by pinching the recording head 9 in the transport direction A. According to a configuration in which the transport unit 18 is disposed on both sides, the recording medium P can be pinched therebetween on both sides. Therefore, it is possible to effectively suppress transport failure such as a paper jam.

As a configuration member of the recording apparatus 1, there may be further provided a configuration member disposed in the recording apparatus in the related art.

An electrical configuration in the recording apparatus 1 according to the embodiment will be described.

Figure 2:
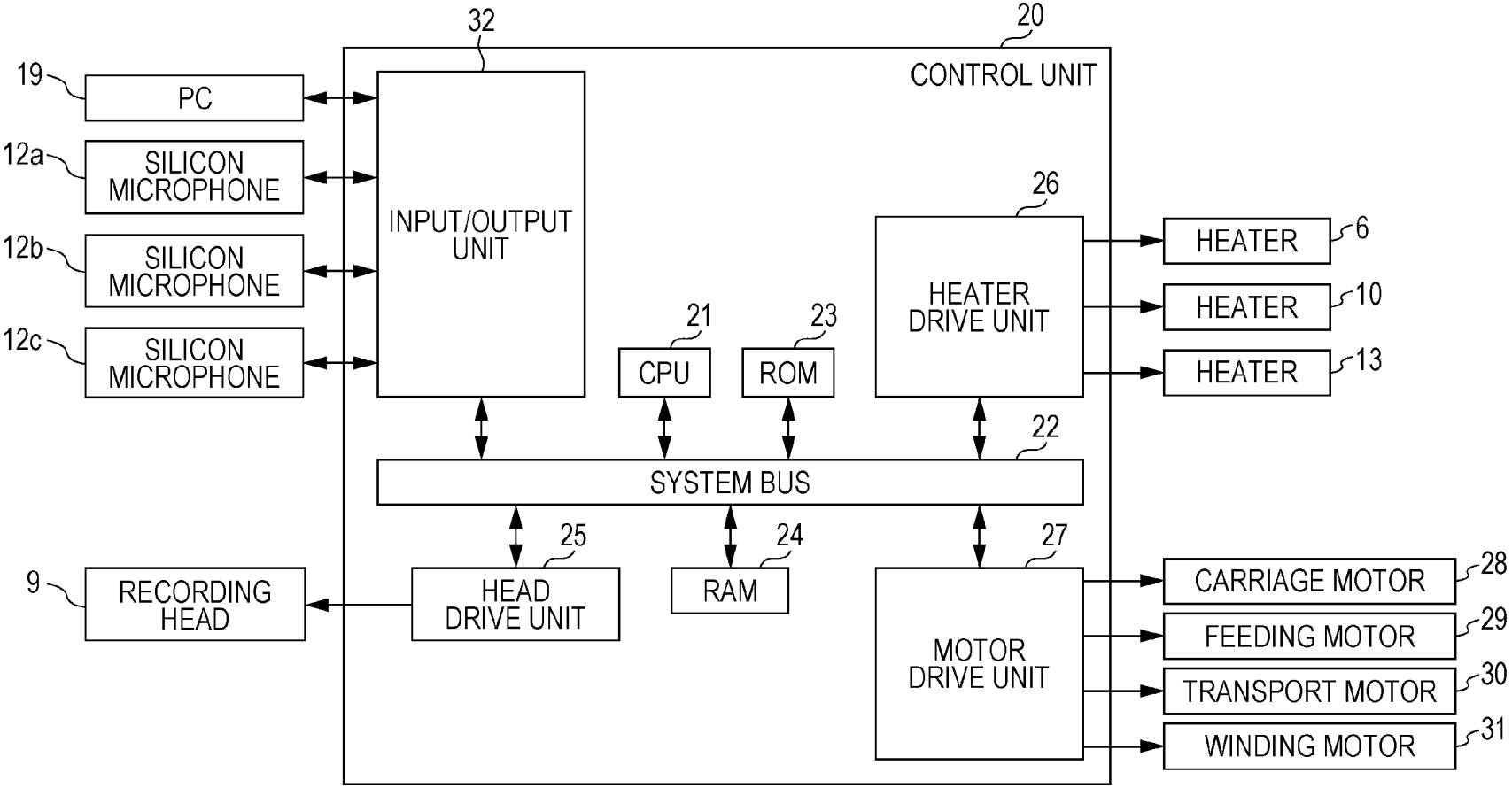
FIG. 2 is a block diagram of the recording apparatus according to the embodiment of the invention.

FIG. 2 is a block diagram of the recording apparatus 1 according to the embodiment.

A control unit 20 has a CPU 21 which controls the overall recording apparatus 1. The CPU 21 is connected via a system bus 22 to a ROM 23 which stores various control programs executed by the CPU 21, and to a RAM 24 which can temporarily store data.

The CPU 21 is connected via the system bus 22 to a head drive unit 25 for driving the recording head 9.

The CPU 21 is connected via the system bus 22 to a heater drive unit 26 for driving the heaters 6, 10, and 13.

The CPU 21 is connected via the system bus 22 to a motor drive unit 27 for driving a carriage motor 28 for moving the carriage 8, a feeding motor 29 serving as a drive source of the setting unit 14, a transport motor 30 serving as a drive source of the driving roller 5, and a winding motor 31 serving as a drive source of the winding unit 15.

Furthermore, the CPU 21 is connected via the system bus 22 to an input/output unit 32 which is connected to the silicon microphones 12*a*, 12*b*, and 12*c*, and a PC 19 which inputs recording data to the recording apparatus 1.

According to this configuration, the control unit 20 can determine whether the reciprocating movement of the carriage 8 is normal or abnormal, based on the sound collection result of the silicon microphones 12*a*, 12*b*, and 12*c*.

Therefore, the recording apparatus 1 according to the embodiment is configured to be capable of automatically determining the abnormal reciprocating movement of the carriage 8.

Figure 8A:
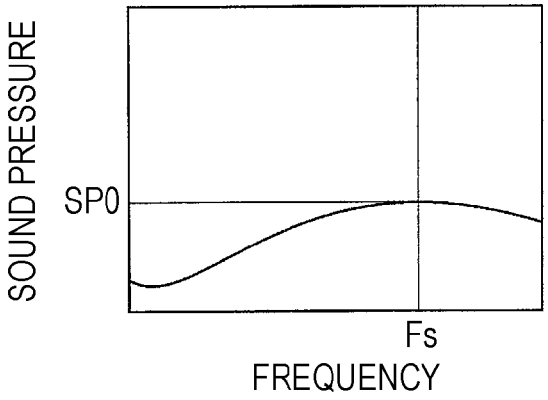
FIGS. 8A to 8C are graphs illustrating a concept of an example of a sound collection result in the recording apparatus according to the embodiment of the invention.

Determining whether the reciprocating movement of the carriage 8 is normal or abnormal will be described with reference to FIGS. 8A to 8C which are graphs illustrating a concept of an example of the sound collection result. FIG. 8A is a graph illustrating a concept of sound pressure with respect to each frequency immediately after the recording apparatus 1 starts to be used, FIG. 8B is a graph illustrating a concept of the sound pressure with respect to each frequency after the recording apparatus 1 is used for a predetermined period of time, and FIG. 8C is a graph illustrating a concept of the sound pressure with respect to each frequency immediately after the recording apparatus 1 is further used for a predetermined period of time.

Figure 8B:
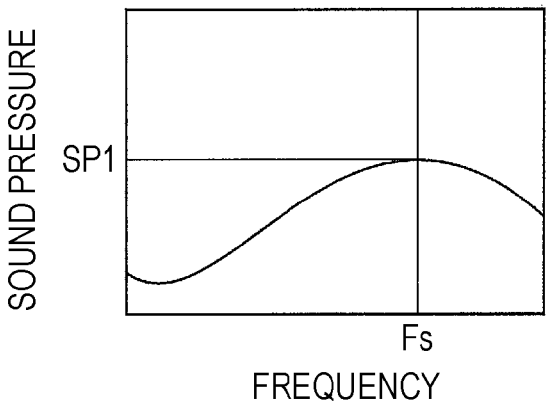
Figure 8C:
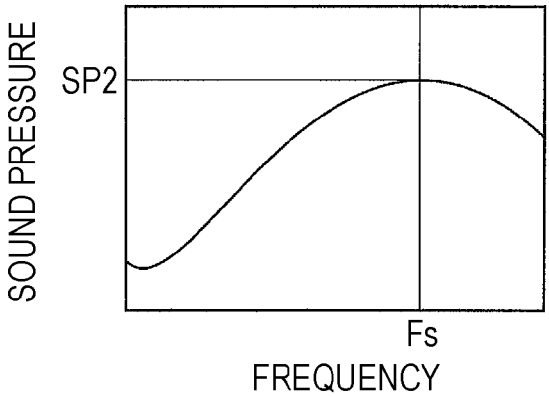

If FIGS. 8A to 8C are compared with one another, peak values SP0, SP1, and SP2 of the sound pressure are present in predetermined frequency Fs, and the values increase progressively from FIG. 8A, FIG. 8B, to FIG. 8C.

Therefore, the recording apparatus 1 according to the embodiment determines whether the reciprocating movement of the carriage 8 is normal or abnormal, based on the value of the sound pressure in the predetermined frequency Fs. The recording apparatus 1 determines that the reciprocating movement of the carriage 8 is normal, based on the value SP1 of the sound pressure in the predetermined frequency Fs in FIG. 8B, and determines that the reciprocating movement of the carriage 8 is abnormal, based on the value SP2 of the sound pressure in the predetermined frequency Fs in FIG. 8C.

However, without being limited to this determination method, for example, a determination method may be used by which it is determined that the reciprocating movement of the carriage 8 is abnormal when predetermined or higher sound pressure is detected in all detection frequency regions of the silicon microphones 12*a*, 12*b*, and 12*c*.

Here, the control unit 20 compares a reference sound stored in the ROM 23 with the sound collected by the silicon microphones 12*a*, 12*b*, and 12*c*, and determines whether the reciprocating movement of the carriage 8 is normal or abnormal.

Therefore, a configuration is adopted in which it is possible to very accurately determine whether the reciprocating movement of the carriage 8 is normal or abnormal.

Here, the "reference sound" means a sound which is collected by the silicon microphones 12*a*, 12*b*, and 12*c* when the reciprocating movement of the carriage 8 is normal, and which is stored in the ROM 23 in advance.

In detail, the reference sound is a predetermined sound corresponding to aging of a sliding state of the carriage 8 along the guide shafts 11*a* and 11*b*. If the recording apparatus 1 is used for a long period of time, a state of contact portions 33*a*, 33*b*, and 33*c* (refer to FIGS. 4 and 5) with respect to the guide shafts 11*a* and 11*b* in the carriage 8 is changed, thereby aging the sliding state of the carriage 8 along the guide shafts 11*a* and 11*b*.

Therefore, the reference sound stored in the ROM 23 in advance is set to a sound estimated in view of the aging corresponding to the used period of the recording apparatus 1, and the sound collection result of the silicon microphones 12*a*, 12*b*, and 12*c* is compared with the reference sound. In this manner, a configuration is adopted in which the recording apparatus 1 according to the embodiment can predict when the reciprocating movement of the carriage 8 is abnormal.

Figure 9:
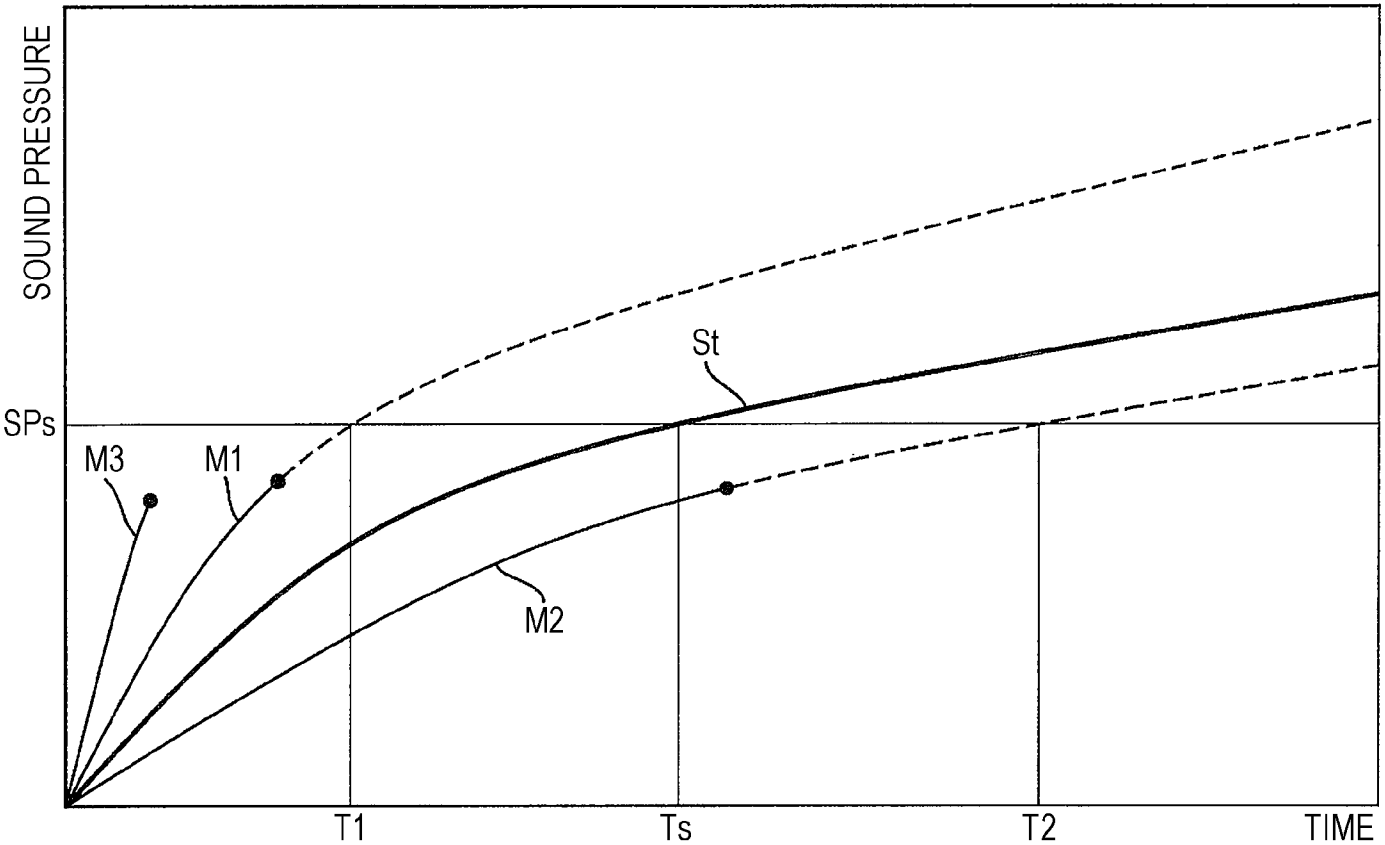
FIG. 9 is a graph illustrating a concept of an example of a sound collection result in the recording apparatus according to the embodiment of the invention.

The comparison between the reference sound and the sound collection result will be described in detail with reference to FIG. 9 which is a graph illustrating a concept of an example of the sound collection result. FIG. 9 illustrates the concept of aging of the sound pressure in predetermined frequency.

In FIG. 9, the reference numeral St is the reference sound, and represents the concept of aging of the sound pressure during the reciprocating movement of the carriage 8. That is, FIG. 9 illustrates a state where the sound pressure increases with the lapse of time. Here, the reference numeral Ts is a time to supply a lubricant, and the sound pressure corresponding to the time is represented by the reference numeral SPs.

The reference numeral M1 is an example of the sound collection result. The recording apparatus 1 according to the embodiment can predict aging of the sound pressure subsequent to the reference numeral M1. The graph is illustrated by a broken line, based on the predicted data. The predicted data enables a user to predict a time T1 when the sound pressure reaches SPs.

The control unit 20 can output the time T1 to and display the time T1 on the PC 19. In this manner, the control unit 20 can notify the user of (call the user's attention to) a fact that the time to supply the lubricant is earlier than a predetermined supply time Ts.

The reference numeral M2 is an example of the sound collection result. The recording apparatus 1 according to the embodiment can predict aging of the sound pressure subsequent to the reference numeral M2. The graph is illustrated by a broken line, based on the predicted data. The predicted data enables a user to predict a time T2 when the sound pressure reaches SPs.

The control unit 20 can output the time T2 to and display the time T2 on the PC 19. In this manner, the control unit 20 can notify the user of the fact that the time to supply the lubricant is earlier than the predetermined supply time Ts. Accordingly, it is possible to suppress unnecessary lubricant supply work.

The reference numeral M3 is an example of further another sound collection result. The recording apparatus 1 according to the embodiment can stop an operation when a slope of aging of the pressure sound is steeper than a predetermined slope as indicated by M3. Then, the control unit 20 can output a fact that the slope of aging of the pressure sound is steeper than the predetermined slope and the recording apparatus 1 is defective, to the PC 19, and can display the fact on the PC 19.

When determining that the reciprocating movement of the carriage 8 is abnormal, the control unit 20 according to the embodiment outputs information indicating that the reciprocating movement of the carriage 8 is abnormal.

Therefore, a configuration is adopted in which the control unit 20 can notify a user of a fact that the reciprocating movement of the carriage 8 is abnormal, by outputting the information to the PC 19 serving as an external display device and displaying the information on a monitor of the PC 19.

The carriage 8 slides along the guide shafts 11*a* and 11*b* via a lubricant. Based on the sound collection result of the silicon microphones 12*a*, 12*b*, and 12*c*, the control unit 20 according to the embodiment outputs information indicating the time to supply the lubricant to the contact portions 33*a*, 33*b*, and 33*c* of the guide shafts 11*a* and 11*b* in the carriage 8.

When the reciprocating movement of the carriage 8 is abnormal, in many cases, the reciprocating movement of the carriage 8 becomes normal by supplying the lubricant to the contact portions 33*a*, 33*b*, and 33*c*.

In the recording apparatus 1 according to the embodiment, based on the sound collection result of the silicon microphones 12*a*, 12*b*, and 12*c*, the control unit 20 outputs information indicating the time to supply the lubricant to the contact portions 33*a*, 33*b*, and 33*c* of the guide shafts 11*a* and 11*b* in the carriage 8, to the PC 19, and displays the information on the PC 19. In this manner, the recording apparatus 1 can notify a user of the time to supply the lubricant. According to this configuration, it is possible to suppress the abnormal reciprocating movement of the carriage 8.

A configuration may be adopted in which the control unit 20 is caused to process the sound collected by the silicon microphones 12*a*, 12*b*, and 12*c*, and in which a first sound collection value (for example, an average value during a first predetermined time period) obtained by collecting the sound generated due to the repeated reciprocating movement during the first predetermined time period and a second sound collection value (for example, an average value during a second predetermined time period) obtained by collecting the sound generated due to the repeated reciprocating movement during the second predetermined time period are output to the control unit 20 so as to be comparable with each other.

Here, without being limited to a configuration in which the control unit 20 obtains the sound collection value by using the sound of the entire movement which is generated due to the repeated reciprocating movement during the predetermined time period, the control unit 20 may obtain the sound collection value by using sounds at several intervals, for example. When the first sound collection value is obtained at several intervals, the second sound collection value may be similarly obtained at several intervals.

The first predetermined time period and the second predetermined time period do not limitedly have consecutive anterior and posterior relationships, and may have a relationship between appropriate time periods or the longer time periods.

The term of "output so as to be comparable with each other" may include any outputting method such as displaying the sound collection value on a display screen and printing the sound collection value, as long as a user can compare both of these with each other.

According to this configuration, the user is enabled to perceive a change in the sliding state in detail.

A configuration may be adopted in which the control unit 20 is caused to process the sound collected by the silicon microphones 12*a*, 12*b*, and 12*c*, and in which a first sound pressure-position graph for obtaining a relationship of a sound pressure value with a position in a movement direction B of the movement unit by collecting a sound generated due to the repeated reciprocating movement during a first predetermined time period, and a second sound pressure-position graph for obtaining a relationship of a sound pressure value with a position in the movement direction B of the movement unit by collecting a sound generated due to the repeated reciprocating movement during a second predetermined time period are output to the control unit 20 so as to be comparable with each other.

Here, without being limited to a configuration in which the control unit 20 obtains the sound pressure-position graph by using the sound of the entire movement which is generated due to the repeated reciprocating movement during the predetermined time period, the control unit 20 may obtain the sound pressure-position graph by using sounds at several intervals, for example. When the first sound pressure-position graph is obtained at several intervals, the second sound pressure-position graph may be similarly obtained at several intervals.

The first predetermined time period and the second predetermined time period do not limitedly have consecutive anterior and posterior relationships, and may have a relationship between appropriate time periods or the longer time periods.

The term of "output so as to be comparable with each other" may include any outputting method such as displaying the sound pressure-position graph on the display screen and printing the sound pressure-position graph, as long as a user can compare both of these with each other.

According to this configuration, the user is enabled to perceive a change in the sliding state in detail.

Figure 10A:
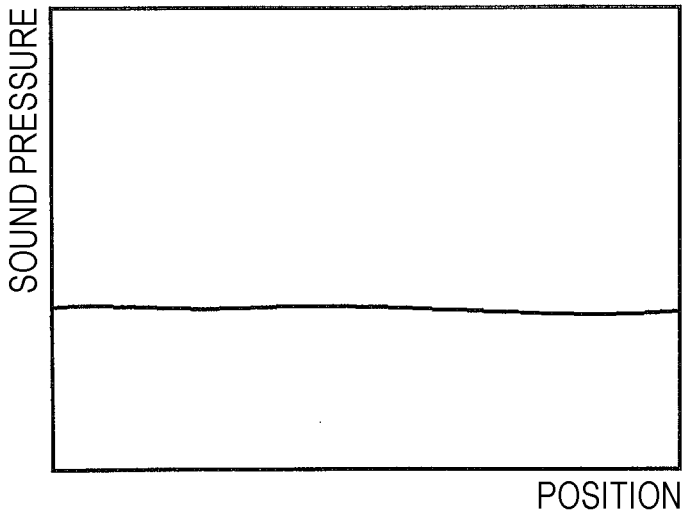
FIGS. 10A and 10B are graphs illustrating a concept of an example of a sound collection result in the recording apparatus according to the embodiment of the invention.
Figure 10B:
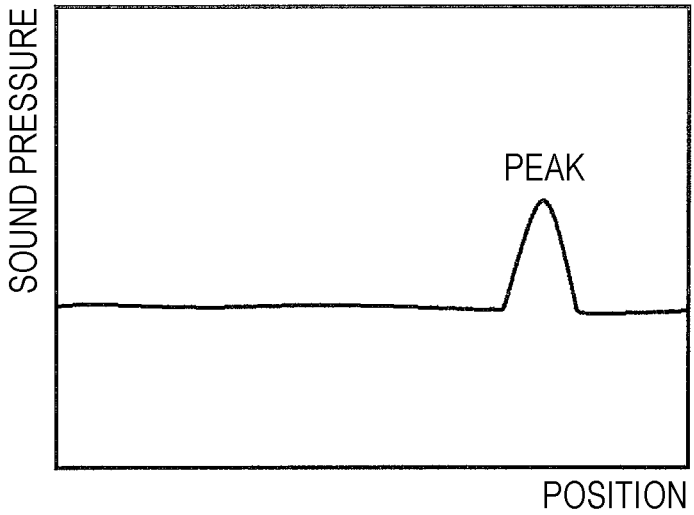

FIGS. 10A and 10B are graphs illustrating a concept of an example of the sound collection result, and are first sound pressure-position graph and the second sound pressure-position graph which are output to the PC 19 by the control unit 20 and are displayed on the monitor of the PC 19. The vertical axis represents the sound pressure, and the horizontal axis represents the position in the direction B.

FIG. 10A is the first sound pressure-position graph when the reciprocating movement of the carriage 8 is normal, and FIG. 10B is the second sound pressure-position graph when the reciprocating movement of the carriage 8 is abnormal.

In FIG. 10A, the sound pressure is substantially constant at any position in the direction B. In contrast, in FIG. 10B, the sound pressure shows a peak.

That is, FIG. 10B illustrates a case where since damage or deformation occurs at a position where the peak is shown, the reciprocating movement of the carriage 8 is defective.

The recording apparatus 1 according to the embodiment notifies a user of the sliding state by displaying this graph.

The first sound pressure-position graph and the second sound pressure-position graph may be separately obtained in a forward route and a rearward route in the reciprocating movement.

According to this configuration, the user is enabled to perceive a change in the sliding state in detail.

Next, the carriage 8 serving as a main unit of the recording apparatus 1 according to the embodiment and an attachment position of the silicon microphones 12*a*, 12*b*, and 12*c* in the carriage 8 will be described.

Figure 3:
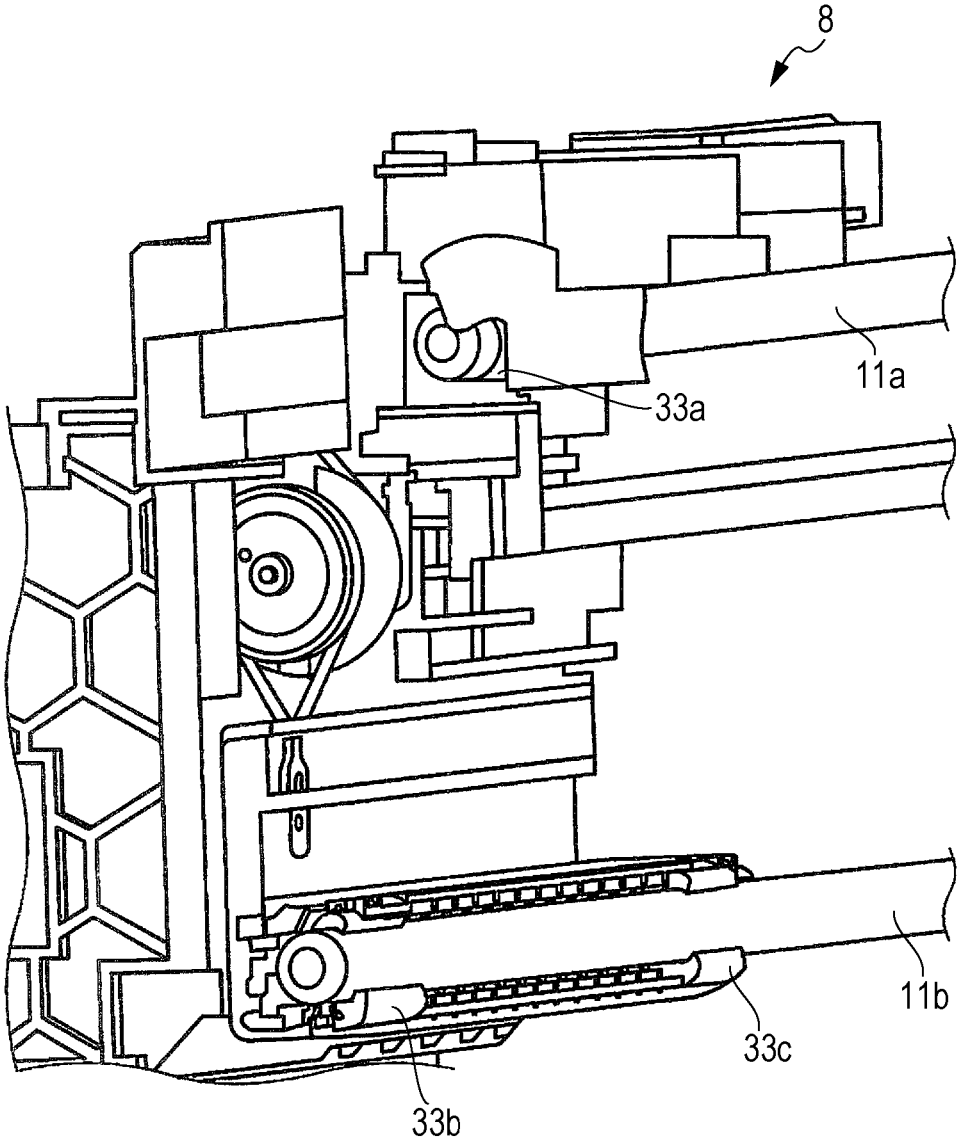
FIG. 3 is a perspective view illustrating a rear surface of a carriage of the recording apparatus according to the embodiment of the invention.
Figure 4:
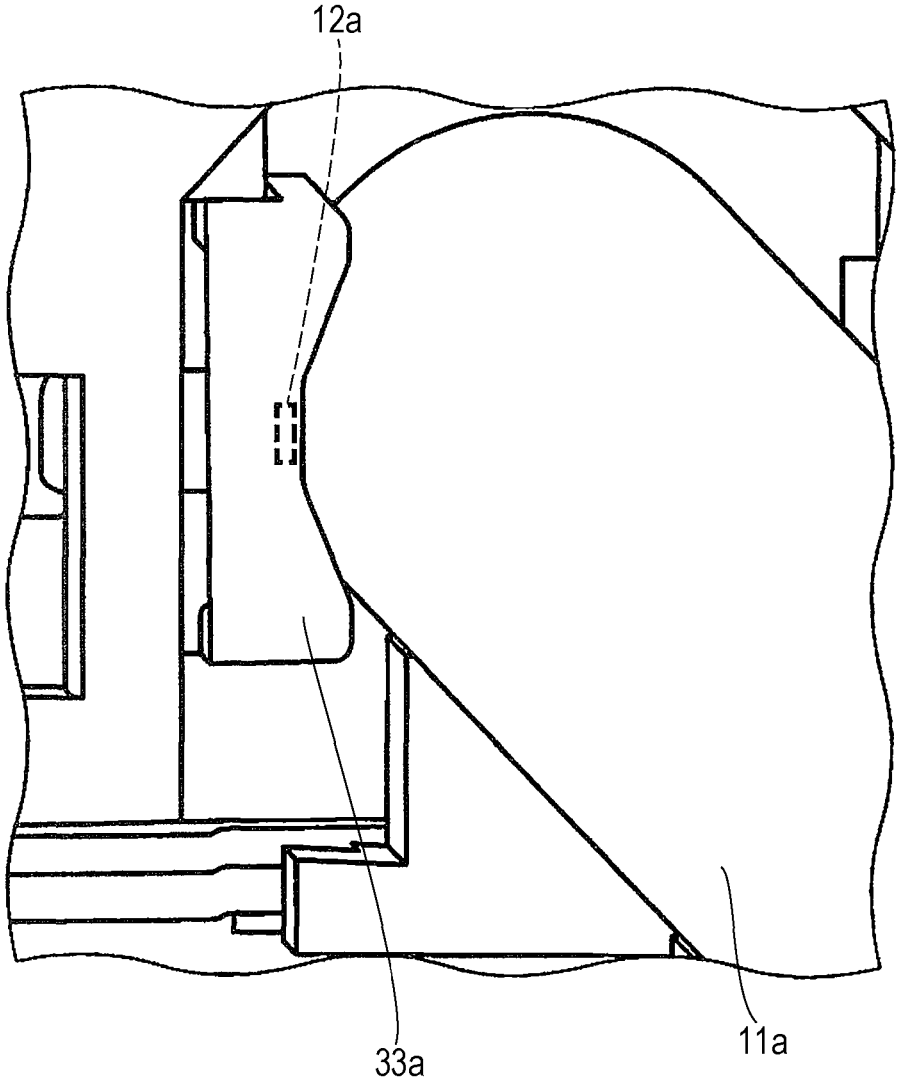
FIG. 4 is a perspective view illustrating a contact portion with a guide shaft in the carriage of the recording apparatus according to the embodiment of the invention.
Figure 5:
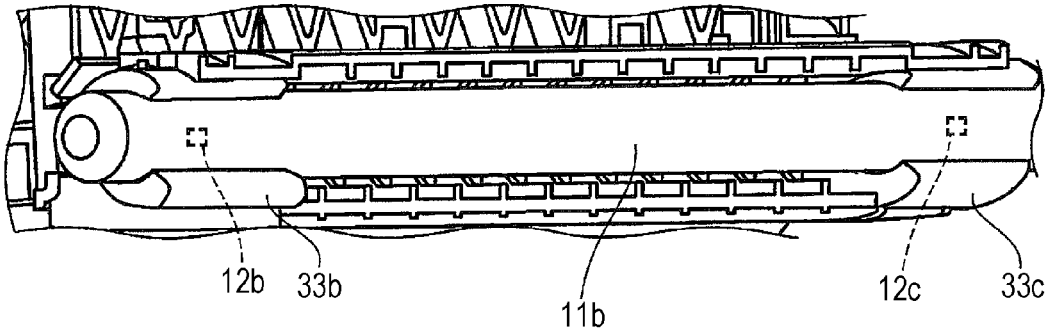
FIG. 5 is a perspective view illustrating the contact portion with the guide shaft in the carriage of the recording apparatus according to the embodiment of the invention.
Figure 6A:
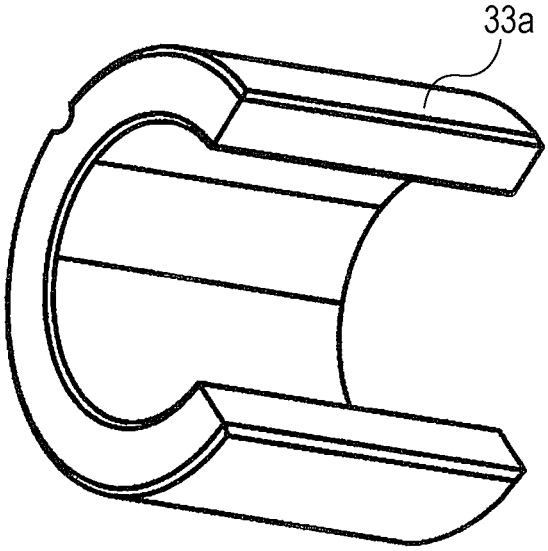
FIGS. 6A and 6B are perspective views illustrating the contact portion with the guide shaft in the carriage of the recording apparatus according to the embodiment of the invention.
Figure 6B:
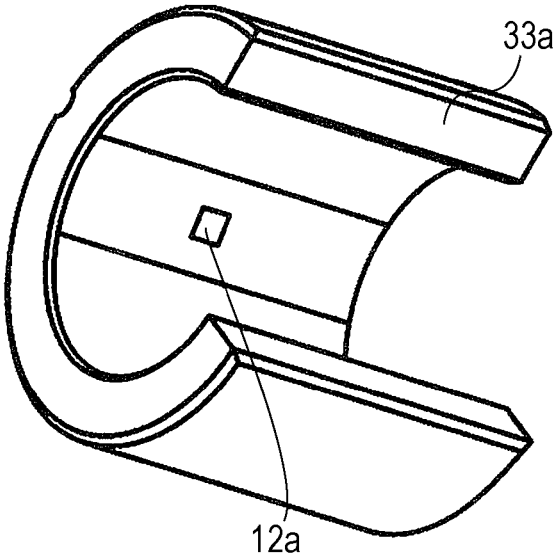
Figure 7A:
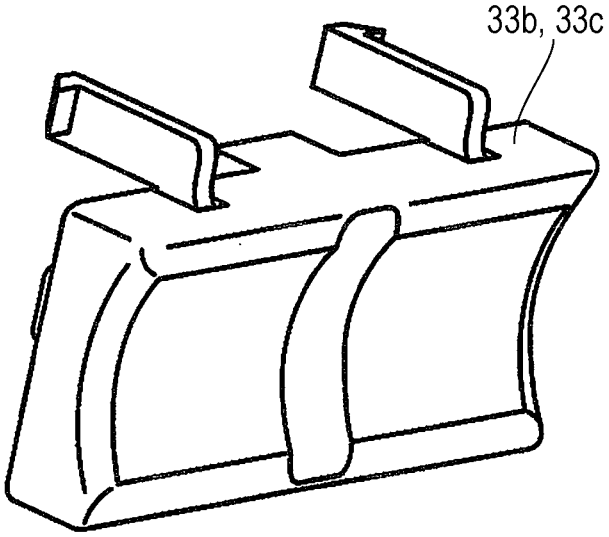
FIGS. 7A and 7B are perspective views illustrating the contact portion with the guide shaft in the carriage of the recording apparatus according to the embodiment of the invention.
Figure 7B:
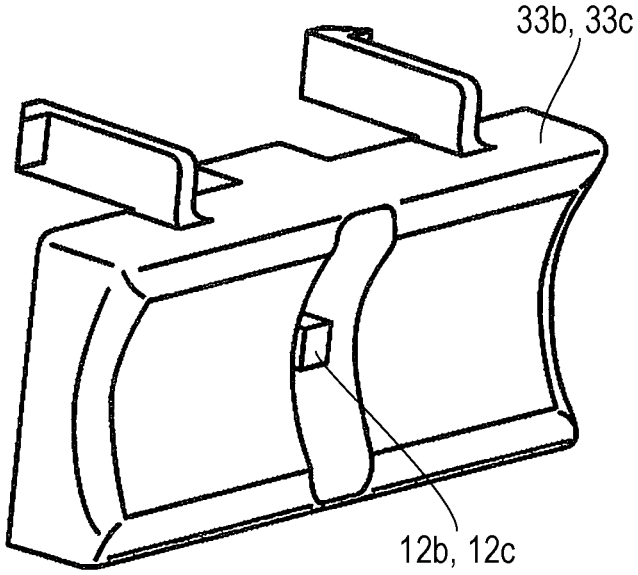

FIG. 3 is a perspective view on a rear surface side of the carriage 8 according to the embodiment, and FIGS. 4 to 7B are perspective views illustrating a contact portion with the guide shaft formed on the rear surface side of the carriage 8 according to the embodiment. FIGS. 4, 6A, and 6B illustrate a contact portion 33*a* which is a contact portion with the guide shaft 11*a*, and FIGS. 5, 7A, and 7B illustrate contact portions 33*b* and 33*c* which are contact portions with the guide shaft 11*b*. FIGS. 6A to 7B illustrate a state where the contact portion is detached from the carriage 8, FIGS. 6A and 7A illustrate a state before a silicon microphone is attached to the contact portion, and FIGS. 6B and 7B illustrate a state after the silicon microphone is attached to the contact portion.

As illustrated in FIGS. 3 to 7B, the silicon microphone 12*a* is disposed to oppose a surface of the guide shaft 11*a* in the carriage 8 at a position by keeping a distance of 0.1 mm to 10 mm therefrom. The silicon microphones 12*b* and 12*c* are disposed to oppose a surface of the guide shaft 11*b* in the carriage 8 at a position by keeping a distance of 0.1 mm to 10 mm therefrom.

Therefore, the silicon microphone 12*a* can effectively collect a sound generated when the carriage 8 reciprocates while sliding along the guide shaft 11*a*. The silicon microphones 12*b* and 12*c* can effectively collect a sound generated when the carriage 8 reciprocates while sliding along the guide shaft 11*b*. Accordingly, the recording apparatus 1 according to the embodiment is configured to be capable of effectively detecting an abnormal reciprocating movement of the carriage 8.

Without being limited to the above-described embodiment, the invention can be modified in various ways within the scope of the invention, and the modification is also included within the scope of the invention as a matter of course.

Hitherto, the invention has been described with reference to the specific embodiments. Here, the invention will be outlined and described again.

The recording apparatus 1 according to an aspect of the invention includes the movement unit 8 which reciprocates while sliding the guide shafts 11*a* and 11*b*, and the sound collection units 12*a*, 12*b*, and 12*c* which are disposed in the movement unit 8 so as to collect the sound generated due to the sliding.

In this case, since the sound collection units 12*a*, 12*b*, and 12*c* are disposed in the movement unit 8, it is possible to detect the abnormal reciprocating movement in the movement unit 8 which can reciprocate while sliding along the guide shafts 11*a* and 11*b*.

Here, the "sound collection unit" means a unit which converts a sound into an electric signal by causing a sound reception portion to receive the sound. The "sound reception portion" means a portion which vibrates by receiving a sound (sound pressure). The "sound" also includes frequency in a non-audible range without being limited to frequency in a human audible range.

In the recording apparatus 1, the sound reception portion of the sound collection units 12*a*, 12*b*, and 12*c* is disposed to oppose the surface of the guide shafts 11*a* and 11*b* in the movement unit 8 by keeping a distance of 0.1 mm to 10 mm therefrom.

In this case, the sound reception portion of the sound collection units 12*a*, 12*b*, and 12*c* is disposed to oppose the surface of the guide shafts 11*a* and 11*b* in the movement unit 8 by keeping the distance of 0.1 mm to 10 mm therefrom. Therefore, it is possible to effectively collect a sound generated when the movement unit 8 reciprocates while sliding along the guide shafts 11*a* and 11*b*. Accordingly, it is possible to effectively detect the abnormal reciprocating movement.

In the recording apparatus 1, the sound collection units 12*a*, 12*b*, and 12*c* are the silicon microphones.

In this case, the sound collection units 12*a*, 12*b*, and 12*c* are the silicon microphones. The silicon microphone is small and has an advantageous sound collection effect. Moreover, the silicon microphone has excellent durability and can be used for a long period of time under various environmental conditions. Therefore, the silicon microphone can be arranged close to a desired location for sound collection, and can serve as very precise and long-term durable sound collection unit.

The recording apparatus 1 further includes the determination unit 20 which determines whether the reciprocating movement of the movement unit 8 is normal or abnormal, based on the sound collection result of the sound collection units 12*a*, 12*b*, and 12*c*.

In this case, there is provided the determination unit 20 which determines whether the reciprocating movement of the movement unit 8 is normal or abnormal, based on the sound collection result of the sound collection units 12*a*, 12*b*, and 12*c*. Therefore, it is possible to automatically determine the abnormal reciprocating movement.

In the recording apparatus 1, the determination unit 20 determines whether the reciprocating movement of the movement unit 8 is normal or abnormal by comparing the reference sound with the sound collected by the sound collection units 12*a*, 12*b*, and 12*c*.

In this case, the determination unit 20 determines whether the reciprocating movement of the movement unit 8 is normal or abnormal by comparing the reference sound with the sound collected by the sound collection units 12*a*, 12*b*, and 12*c*. Therefore, it is possible to very accurately determine whether the reciprocating movement of the movement unit 8 is normal or abnormal.

Here, the "reference sound" means a sound which is collected by the sound collection units 12*a*, 12*b*, and 12*c* when the reciprocating movement of the movement unit 8 is normal, and which is stored in the recording apparatus 1 in advance, for example.

In the recording apparatus 1, the reference sound is a predetermined sound corresponding to aging of a sliding state of the movement unit 8 along the guide shafts 11*a* and 11*b*.

In this case, the reference sound is the predetermined sound corresponding to aging of the sliding state of the movement unit 8 along the guide shafts 11*a* and 11*b*. Therefore, it is possible to predict the time when the reciprocating movement of the movement unit 8 becomes abnormal, based on a difference between the reference sound and the detected sound.

The "predetermined sound corresponding to aging of the sliding state of the movement unit 8 along the guide shafts 11*a* and 11*b*" can be associated with sound pressure of a sound having predetermined frequency corresponding to the used period of the recording apparatus 1.

In the recording apparatus 1, the movement unit 8 slides along the guide shafts 11*a* and 11*b* via the lubricant. The determination unit 20 outputs the information indicating the time to supply the lubricant to the contact portions 33*a*, 33*b*, and 33*c* with the guide shafts 11*a* and 11*b* in the movement unit 8, based on the sound collection result of the sound collection units 12*a*, 12*b*, and 12*c*.

When the reciprocating movement of the movement unit 8 is abnormal, in many cases, the reciprocating movement of the movement unit 8 becomes normal by supplying the lubricant to the contact portions 33*a*, 33*b*, and 33*c*. In this case, the determination unit 20 outputs the information indicating the time to supply the lubricant to the contact portions 33*a*, 33*b*, and 33*c* with the guide shafts 11*a* and 11*b* in the movement unit 8, based on the sound collection result of the sound collection units 12*a*, 12*b*, and 12*c*. Therefore, the determination unit 20 can notify a user of the time to supply the lubricant, by outputting the information to an external display device and displaying the information on the external display device. Accordingly, it is possible to suppress the abnormal reciprocating movement of the movement unit 8.

In the recording apparatus 1, when determining that the reciprocating movement of the movement unit 8 is abnormal, the determination unit 20 outputs the information indicating that the reciprocating movement of the movement unit 8 is abnormal.

In this case, when determining that the reciprocating movement of the movement unit 8 is abnormal, the determination unit 20 outputs the information indicating that the reciprocating movement of the movement unit 8 is abnormal. Therefore, the determination unit 20 can notify a user of the fact that the reciprocating movement of the movement unit 8 is abnormal, by outputting the information to an external display device and displaying the information on the external display device.

The recording apparatus 1 further includes the processing unit 20 which processes the sound collected by the sound collection units 12*a*, 12*b*, and 12*c*. The processing unit 20 includes the output unit which outputs the first sound collection value obtained by collecting the sound generated due to the repeated reciprocating movement during the first predetermined time period, and the second sound collection value obtained by collecting the sound generated due to the repeated reciprocating movement during the second predetermined time period, so as to be comparable with each other. In this case, a user is enabled to perceive a change in the sliding state in detail.

The recording apparatus 1 further includes the processing unit 20 which processes the sound collected by the sound collection units 12*a*, 12*b*, and 12*c*. The processing unit 20 includes the output unit which outputs the first sound pressure-position graph for obtaining the relationship of the sound pressure value with the position in the movement direction of the movement unit 8 by collecting the sound generated due to the repeated reciprocating movement during the first predetermined time period, and the second sound pressure-position graph for obtaining the relationship of the sound pressure value with the position in the movement direction of the movement unit 8 by collecting the sound generated due to the repeated reciprocating movement during the second predetermined time period, so as to be comparable with each other. In this case, a user is enabled to perceive a change in the sliding state in detail.

In the recording apparatus 1, the processing unit 20 separately obtains the first sound pressure-position graph and the second sound pressure-position graph in the forward route and the rearward route in the reciprocating movement. In this case, a user is enabled to perceive a change in the sliding state in detail.

The entire disclosure of Japanese Patent Application No. 2014-064548, filed Mar. 26, 2014 is expressly incorporated by reference herein.

What is claimed is:

1. A recording apparatus comprising:

a movement unit that reciprocates while sliding along a guide shaft;

a sound collection unit that is disposed in the movement unit and collects a sound generated due to the sliding; and a processing unit that processes a sound collected by the sound collection unit, wherein the processing unit includes an output unit which outputs a first sound pressure-position graph for obtaining a relationship of a sound pressure value with a position in a movement direction of the movement unit by collecting a sound generated due to the repeated reciprocating movement during a first predetermined time period, and a second sound pressure-position graph for obtaining a relationship of a sound pressure value with a position in the movement direction of the movement unit by collecting a sound generated due to the repeated reciprocating movement during a second predetermined time period, so as to be comparable with each other, wherein the processing unit separately obtains the first sound pressure-position graph and the second sound pressure-position graph in a forward route and a rearward route in the reciprocating movement.

2. The recording apparatus according to claim 1, wherein a sound reception portion of the sound collection unit is disposed to oppose a surface of the guide shaft in the movement unit at a position by keeping a distance of 0.1 mm to 10 mm therefrom.

3. The recording apparatus according to claim 1, wherein the sound collection unit is a silicon microphone.

4. The recording apparatus according to claim 1, further comprising:

a determination unit that determines whether the reciprocating movement of the movement unit is normal or abnormal, based on a sound collection result of the sound collection unit.

5. The recording apparatus according to claim 4, wherein the determination unit determines whether the reciprocating movement of the movement unit is normal or abnormal, by comparing a reference sound with a sound collected by the sound collection unit.

6. The recording apparatus according to claim 5, wherein the reference sound is a sound which is predetermined corresponding to aging of a sliding state of the movement unit along the guide shaft.

7. The recording apparatus according to claim 4, wherein the movement unit slides along the guide shaft via a lubricant, and wherein the determination unit outputs information indicating the time to supply a lubricant to a contact portion with the guide shaft in the movement unit, based on a sound collection result of the sound collection unit.

8. The recording apparatus according to claim 4, wherein the determination unit outputs information indicating that the reciprocating movement of the movement unit is abnormal when determining the reciprocating movement of the movement unit is abnormal.

9. The recording apparatus according to claim 1, wherein the output unit which outputs a first sound collection value obtained by collecting a sound generated due to the repeated reciprocating movement during a first predetermined time period and a second sound collection value obtained by collecting a sound generated due to the repeated reciprocating movement during a second predetermined time period, so as to be comparable with each other.

* * * * *